US005201902A

United States Patent [19]

Baer

[11] Patent Number: 5,201,902

[45] Date of Patent: Apr. 13, 1993

[54] GEAR HINGE WITH KNUCKLE-TYPE BEARING

[76] Inventor: Austin R. Baer, 430 Kolber Ct., Villa Park, Ill. 60181

[21] Appl. No.: 710,967

[22] Filed: Jun. 6, 1991

[51] Int. Cl.[5] ..... E05D 1/00

[52] U.S. Cl. ..... 16/354; 16/273; 16/DIG. 27

[58] Field of Search ..... 16/354, 273, DIG. 27

[56] References Cited

U.S. PATENT DOCUMENTS 3,402,422 9/1968 Baer ..... 16/354
4,976,008 12/1990 Baer ..... 16/354
4,996,739 3/1991 Baer ..... 16/354
5,062,181 11/1991 Bobbowski et al. ..... 16/354

*Primary Examiner*—Lowell A. Larson
*Assistant Examiner*—Carmine Cuda
*Attorney, Agent, or Firm*—Polster, Lieder, Woodruff & Lucchesi

[57] ABSTRACT

A gear hinge has a bearing fitted into opposed notches which open out of the meshed gear segments for the leaves. The bearing has blocks provided with knuckles which interlock to prevent the blocks, and the leaves as well, from moving longitudinally with respect to each other.

22 Claims, 4 Drawing Sheets

FIG. 4.
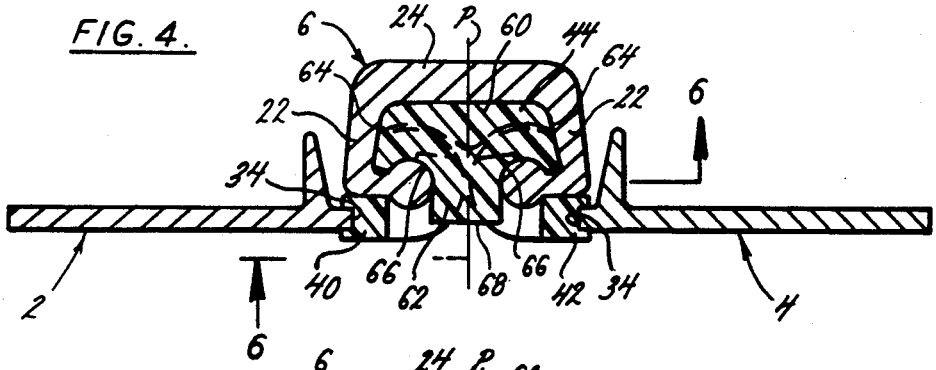
FIG. 5.
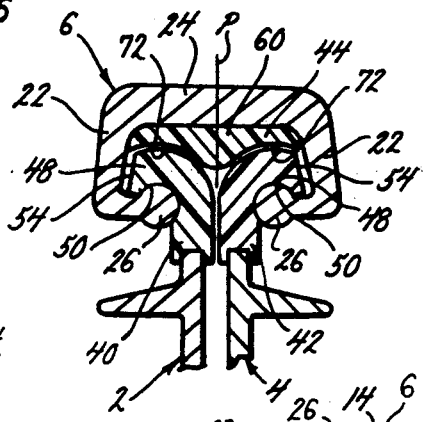
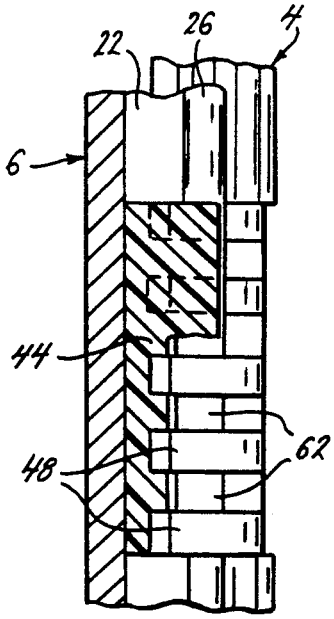
FIG. 7.
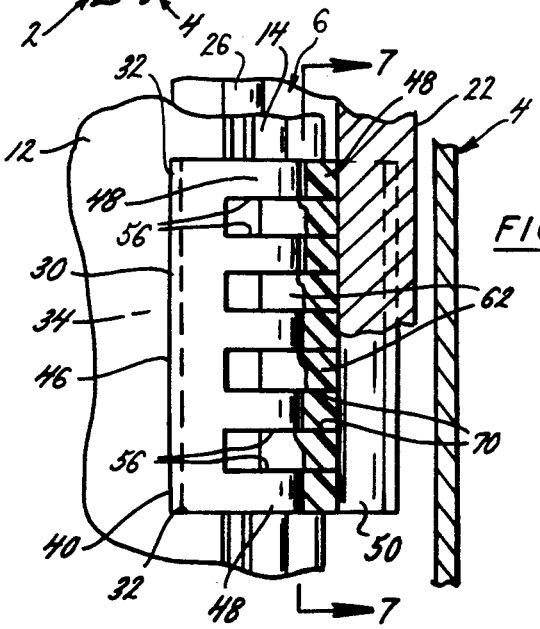
FIG. 6.
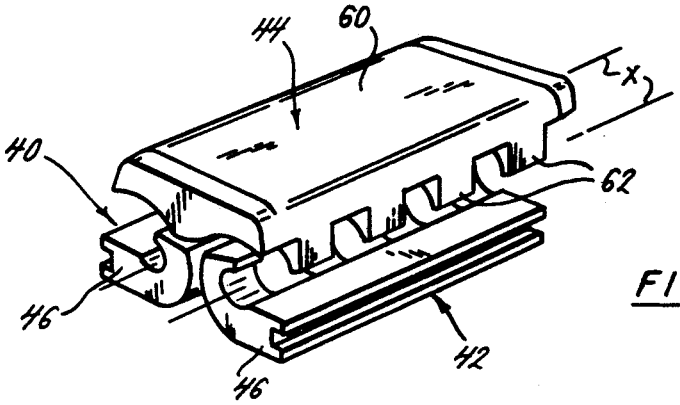
FIG. 8.

FIG. 9.
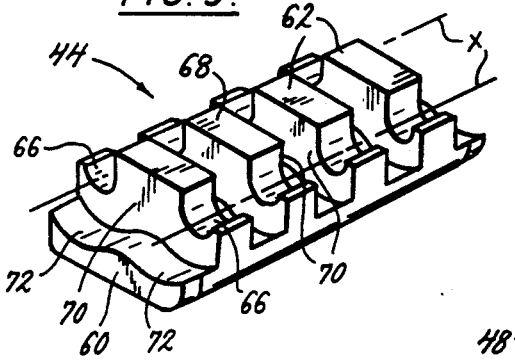
FIG. 10.
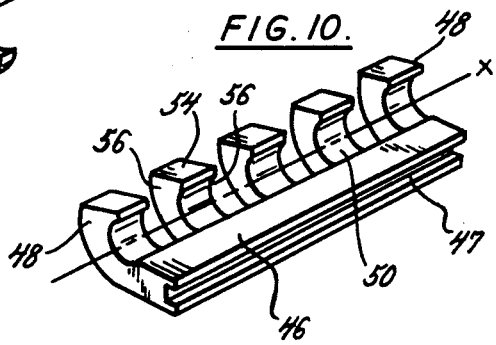
FIG. 12.
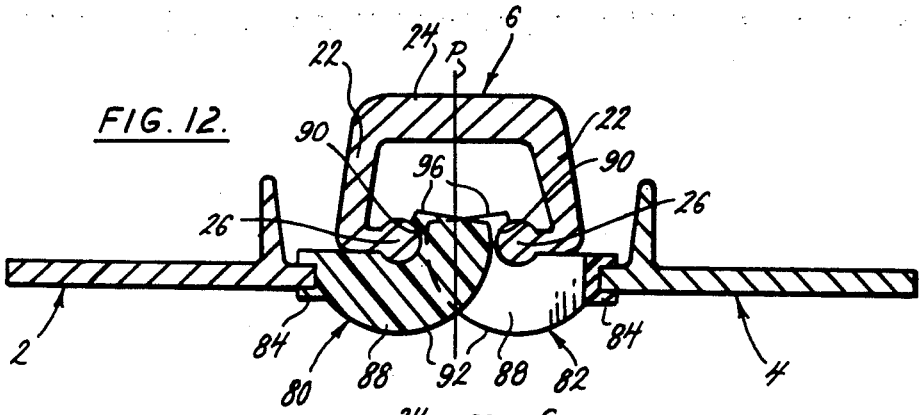
FIG. 13.
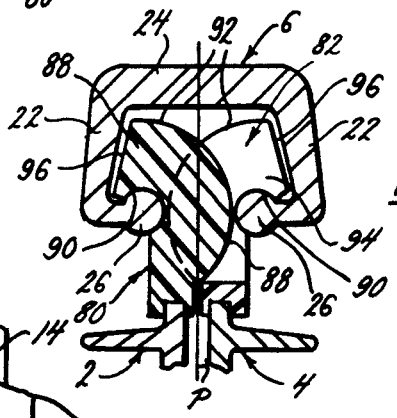
FIG. 11.
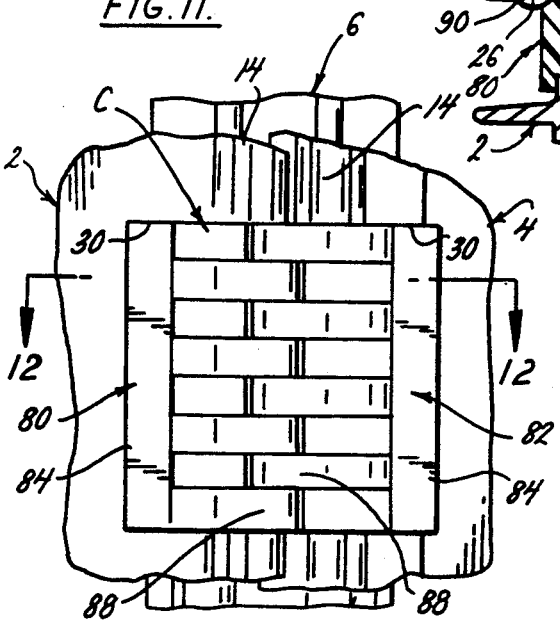
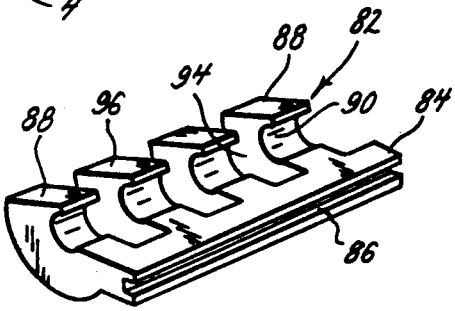
FIG. 14.

GEAR HINGE WITH KNUCKLE-TYPE BEARING

BACKGROUND OF THE INVENTION

This invention relates in general to gear hinges and more particularly to knuckle-type bearings for gear hinges and to gear hinges having such bearings.

A door attached to a door frame with traditional pin-type hinges has its weight concentrated at the few relatively small areas at which the hinges are located. Due to the concentration of weight at these areas, it is not uncommon to find the screws which secure the hinge leaves pulled free from the door or hinge jamb, or to find the jamb bent, or to find the hinge leaves themselves bent, particularly when the door is subjected to abuse. A continuous gear hinge, on the other hand, usually extends the entire length of a hinge jamb and door and thus distributes the weight of the door over a much larger area. For this reason gear hinges are often installed on doors which see heavy use, such as those found in public buildings, or on doors which encounter abuse, such as those at schools.

A gear hinge basically consists of two leaves having meshing gear segments, a clamp for holding the gear segments together so that the door leaf can rotate relative to the jamb leaf while the gear segments remain meshed, and a bearing block for preventing the door leaf from shifting longitudinally relative to the jamb leaf. A gear hinge for a typical door will have several bearing blocks fitted to cutouts formed in its gear segments, and these blocks, which are usually molded from plastic, carry essentially the entire weight of the door. As the hinge opens and closes, the metal edges of the cutouts in the gear segments slide over the end faces of the plastic blocks, and the blocks wear. In time they must be replaced, and this usually requires removing the hinge from the door jamb to obtain enough clearance to slide the clamp free of the gear segments. U.S. Pat. No. 3,402,422 shows a gear hinge having a traditional bearing.

The present invention resides in a gear hinge and a bearing for such a hinge. The bearing has blocks provided with interlocking knuckles, the side faces of which serve as low friction surfaces through which thrust or longitudinal loading on the hinge is transmitted.

DESCRIPTION OF THE DRAWINGS

In the accompanying drawings which form part of the specification and wherein like numerals and letters refer to like parts wherever they occur:

FIG. 4 is a sectional view taken along line 4—4 of FIG. 1 and also showing the bearing in section;

FIG. 5 is a sectional view similar to FIG. 3, but showing the hinge leaves closed instead of open;

FIG. 6 is a fragmentary sectional view taken along line 6—6 of FIG. 4;

FIG. 7 is a sectional view taken along line 7—7 of FIG. 6;

FIG. 8 is a perspective view of the bearing showing its two bearing blocks interlocked with the intervening block;

FIG. 9 is a perspective view of the intermediate block of the bearing;

FIG. 10 is a perspective view showing one of the two bearing blocks that pivot relative to the intervening block;

FIG. 11 is a front view of a hinge provided with a modified bearing;

FIG. 12 is a sectional view taken along line 12—12 of FIG. 11 and showing the modified bearing in section;

FIG. 13 is a sectional view similar to FIG. 12, but showing the leaves of the hinge closed instead of open;

FIG. 14 is a perspective view of one of the bearing blocks for the modified bearing;

DETAILED DESCRIPTION

Figure 1:
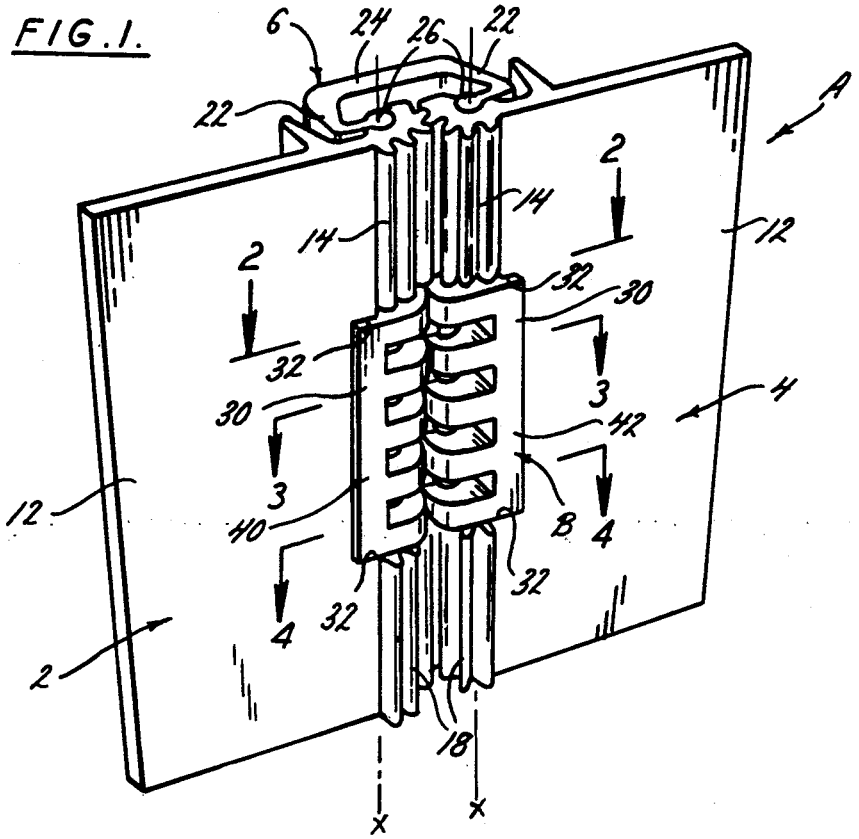
FIG. 1 is a perspective view of a gear hinge provided with a knuckle-type bearing constructed in accordance with and embodying the present invention.

Referring now to the drawings, a continuous gear hinge A (FIG. 1) includes a pair of leaves 2 and 4 and a clamp 6 which holds the leaves 2 and 4 together, yet enables one to pivot relative to the other. In addition, the hinge A has a bearing B which prevents the leaves 2 and 4 from shifting longitudinally with respect to each other. Typically the leaf 2 is attached to the hinge jamb of a door frame, while the leaf 4 is fastened to a door which swings into and out of the door frame. Both the leaves 2 and 4 are about as long as the door is high and are secured with screws or bolts to door jamb and door, respectively, at well-spaced locations, not just at two or three concentrated areas as are the leaves of conventional hinges. This serves to spread the weight of the suspended door over essentially the entire height of the door and frame. The leaves 2 and 4 and the clamp 6 are old, except insofar as they cooperate with the bearing B. The invention in essence resides in the bearing B, of which several are normally utilized.

Each leaf 2 and 4 includes (FIGS. 1 and 2) a mounting plate 12, which is essentially flat and elongated or otherwise shaped to conform to the contour of a door or door jamb, and a gear segment 14, which curves outwardly and backwardly about a concave bearing surface 16. The gear segment 14 is formed integral with the mounting plate 12, preferably as an aluminum extrusion. The gear segment 14 of course has teeth 18, and they lie along an arc that is concentric to the bearing surface 16; both have their centers along a pivot axis x that lies parallel to the surfaces of the plate 12. The plate 12 of the leaf 2 is configured to fit against the hinge jamb of a door frame, whereas the plate 12 of the leaf 4 is configured to fit along the edge of a door or it may be configured to form an actual stile of a panel-type door, having a channel for receiving a glass, plywood or similar panel. The teeth 18 of the two leaves 2 and 4 mesh for essentially the full length of the hinge A, and indeed remain meshed as the leaf 4 swings between open and closed positions with respect to the leaf 2. In the closed position, the mounting plates 12 of the two leaves 2 and 4 face each other and are essentially together. In the open position the plates 12 are spread apart.

The clamp 6 fits around the gear segments 14 of the two leaves 2 and 4 (FIG. 2) and bears against the respective bearing surfaces 16, thereby holding the gear segments 14 together, so that their teeth 18 remain meshed To this end, the clamp 6 possesses a generally U-shaped configuration, it having two side legs 22 and an intervening bight portion 24. The ends of the two legs 22 turn inwardly toward each other and terminate at cylindrical ribs 26 which are parallel to each other and to the legs 22 and bight portion 24 as well. The center-to-center spacing between the two ribs 26 equals that which exists between the bearing surfaces 16 of the two gear segments 14 when the gear segments 14 are properly meshed. Indeed, the cylindrical ribs 26 fit into the concave bearing surfaces 16 of the gear segments 14 and prevent the gear segments 14 and their leaves 2 and 4 from separating. In this regard, the radius of each cylindrical rib 26 matches the radius of the bearing surface 16 into which it fits, and hence the axes of the ribs 26 coincide with the pivot axes x of the gear segments 14. When leaves 2 and 4 are closed, the gear segments 14 for the most part lie within the interior of the clamp 6, their free ends being along the inside faces of the legs 22 for the clamp 6. On the other hand, when the leaves 2 and 4 are spread fully apart, only the ends of the gear segments 14 lie between the two ribs 26 and the ends of the legs 22 on the clamp 6 lie near the mounting plates 12.

Whereas the mounting plates 12 are continuous throughout the lengths of their respective leaves 2 and 4, the gear segments 14 are not. Each gear segment 14 is interrupted at at least one location by a notch 30 (FIGS. 1 and 6) which opens out of it toward the gear segment 14 of the other hinge leaf 2 or 4. Moreover, for every notch 30 in the gear segment 14 of the leaf 2 another notch 30 exists in the gear segment 22 of the leaf 4 at essentially the same location. In other words, the notches 30 of the two leaves 2 and 4 are presented opposite to each other so that they open into each other. Actually, each notch 30 extends inwardly through its gear segment 14 and into the mounting plate 12 along which the gear segment 14 lies. It has transverse upper and lower edges 32 which lie in planes that are perpendicular to pivot axes x and a longitudinal edge 34 that connects the surfaces 32 and lies parallel to the axes x. The bearing B fits into the opposed notches 30 of the two leaves 2 and 4 and into the adjoining interior region of the clamp 30, and prevents the meshed gear segments 14 and their respective leaves 2 and 4 from shifting longitudinally with respect to each other. The notches 30 are formed by a simple milling operation.

The bearing B consists of two bearing blocks 40 and 42 which are fitted to the leaves 2 and 4, respectively and lie within the notches 30 of those leaves and an intervening block 44 which is located within the interior of the clamp 6 (FIG. 8). All three blocks 40, 42 and 44 are molded or otherwise formed from a low friction polymer, such as nylon or Delrin, or from any other material or materials which enable the blocks 40 and 42 to work against the block 44 with minimum friction and wear. As the leaves 2 and 4 move between their open and closed positions (FIGS. 3 and 5), surfaces of the blocks 40 and 42 move over surfaces on the intervening block 44, experiencing minimal friction, owing to the low friction characteristics of the material from which they are made. The blocks 40 and 42 remain fixed in position with respect to their respective leaves 2 and 4, whereas the intervening block 44 remains fixed with respect to the clamp 6.

Figure 3:
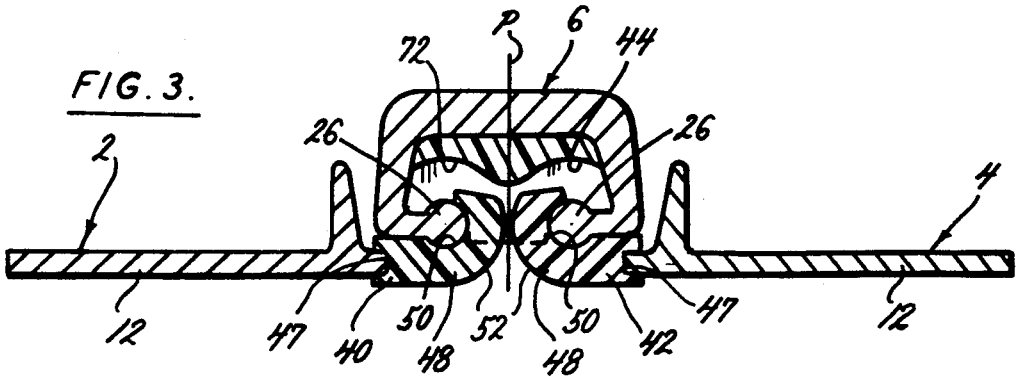
FIG. 3 is a sectional view taken along line 3—3 of FIG. 1 and showing the bearing in section.

The bearing block 40 fits into the notch 30 of the leaf 2 and is confined to the notch 30 in the sense that it does not project radially beyond the gear segment 14 for that leaf. Likewise, the bearing block 42 fits into the notch 30 of the leaf 4 and does not project beyond the gear segment 14 of that leaf. Each block 40 and 42 includes (FIG. 10) a base 46 that lies along the longitudinal edge 34 of the notch 30 for its leaf 2 or 4, and indeed the base 46 contains a groove 47 which receives the longitudinal edge 34 or some other shape for enabling the block 40 or 42 to interlock with the mounting plate 12 in which its notch 30 exists. This prevents the blocks 40 and 42 from turning in the notches 30 of their respective mouonting plates 12. In addition, the block 40 has a series of knuckles 48 which project from the base 46 and curve backwardly about the pivot axis x for the gear segment 14. More specifically, each knuckle 48 has an arcuate inner surface 50 which conforms in contour to the cylindrical rib 26 that lies along its axis X and a convex outer surface 52 which in the region of the base 46 is straight, but remote from the base 46 is convex. The contour of the outer surface 52 is such that irrespective of position of rotation for the knuckle 48 of which it is a part, the outer surface 52 never passes beyond a plane p that bisects the clamp 6 and extends through the region where the gear segments 14 of the two leaves 2 and 4 mesh (FIGS. 3, 5 and 10). Each knuckle 48 terminates at an end face 54 which lies along a leg 22 of the clamp 6 when the hinge leaves 2 and 4 are closed. Finally, the knuckles 48 have bearing or side faces 56 which are parallel and lie in planes perpendicular to the pivot axis x.

Figure 2:
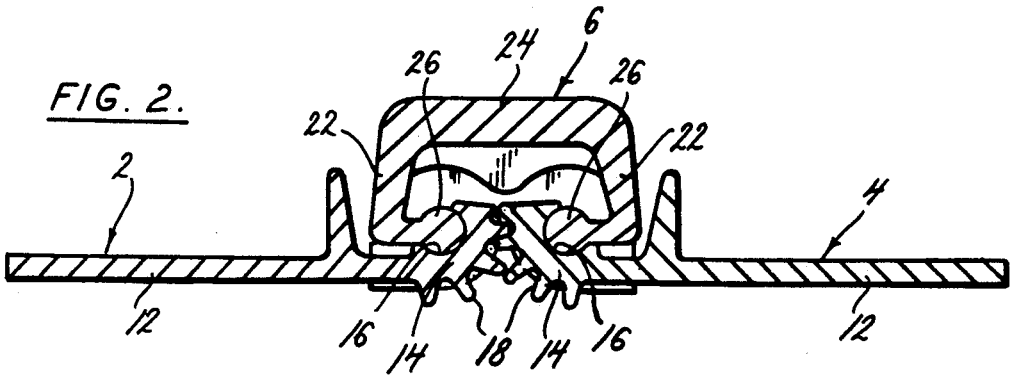
FIG. 2 is a sectional view of the gear hinge taken along line 2—2 of FIG. 1.

Within the hinge A, the knuckles 48 of the two bearing blocks 40 and 42 align transversely, that is to say, for each knuckle 48 on the block 40 a corresponding knuckle 48 exists on the block 42, and the two knuckles 48 are presented directly opposite to each other (FIGS. 1, 6 and 8). Since the knuckles 48 of the two blocks 40 and 42 align, the spaces between the knuckles 48 on the two blocks 40 and 42 likewise align. Notwithstanding the alignment of the knuckles 48 of the two blocks 40 and 42, these knuckles 48 never interfere with each other as the hinge leaves 2 and 4 move between the open and closed positions, because the knuckles 48 never project beyond the bisecting plane p of the hinge A (FIGS. 3 and 5). However, the intervening block 44 does cross the bisecting plane p (FIG. 4), and serves to interlock the two bearing blocks 40 and 42 such that their respective leaves 2 and 4 cannot shift longitudinally with respect to each other.

The intervening block 44 lies for the most part within the interior of the clamp 6, and it too has (FIG. 9) a base 60 and knuckles 62 which project from the base 60, extending the full width of the base 20. The knuckles 62 have end faces 64 which lie along the legs 22 for the clamp 6. They project outwardly beyond the cylindrical ribs 26 of the clamp 6, and to accommodate the ribs 26, each is provided with two arcuate cutouts 66. Each knuckle 62 terminates at an outside face 68 which is set slightly inwardly from bases 46 of the two bearing blocks 40 and 42 when the hinge A is open. The knuckles 62 of the intervening block 44 have bearing or side faces 70 which lie in planes that are parallel to each other and perpendicular to the pivot axes x of the two leaves 2 and 4. The spacing between the knuckles 62 for the intervening block 44 is essentially equivalent to the thickness of the knuckles 48 on the bearing blocks 40 and 42, and likewise the spacing between the knuckles 48 on the blocks 40 and 42 is essentially equivalent to the thickness of the knuckles 62 on the intervening block 44. Indeed, the knuckles 62 of the intervening block 44 fit into the spaces between the knuckles 48 on the two bearing blocks 40 and 42 so that the side faces 70 of the knuckles 62 are against the side faces 56 for the knuckles 48. Thus, within each space between knuckles 62 of the intervening block 44 lie two knuckles 48—one from each of the bearing blocks 42 and 40. In the spaces between the knuckles 62, the block 44, the base 60 has contoured surfaces 72 which generally conform to the curvature of the convex portions on the outer surfaces 52 for the two knuckles 48 in that space.

The interlocking knuckles 48 and 62 prevent the bearing blocks 40 and 42 from shifting longitudinally with respect to the intervening block 44, that is to say along the pivot axes x, yet permit rotation about the pivot axes x. Being confined between the transverse edges 32 in the notches 30 of their respective leaves 2 and 4, the interlocked bearing blocks 40 and 42 and block 44 prevent the leaves 2 and 4 from shifting longitudinally with respect to each other.

To assemble the hinge A, one first fits the blocks 40 and 42 of the bearing B into the notches 30 of the two leaves 2 and 4. Then the leaves 2 and 4 are brought together such that the teeth 18 of the gear segments 14 mesh, while concurrently the remaining block 44 of the bearing B is fitted to the blocks 40 and 42 so that the knuckles 48 and 62 interlock. Finally, the clamp 6 is passed longitudinally over the gear segments 14 and blocks 40, 42 and 44, such that its ribs 26 slide through the bearing surfaces 16 in the gear segments 14 and likewise through the arcuate inner surfaces 50 of the blocks 40 and 42 and the arcuate cutouts 66 of the block 44.

When the hinge leaves 2 and 4 are moved between their closed and their open positions, rotation occurs about the pivot axes x, with that rotation being relative to the clamp 6. Normally the leaf 2 is fixed to a door jamb, while the leaf 4 is on a door. Thus, the change in the hinge reflects the swing of the door. In that case, the hinge leaf 4 rotates relative to the clamp 6 about one of the axes x, while the clamp 6 rotates relative to the leaf 2 about the other axis x. In any event, the block 40 remains with the leaf 2 and the block 42 with the leaf 4 during the relative rotation, while the intervening block 44 remains generally in position in the clamp 6. The knuckles 48 of the two bearing blocks 40 and 42 experience rotation within the spaces between the knuckles 62 of the intervening block 44, yet the bearing blocks 40 and 42 are prevented from drawing away from their leaves 2 and 4. In this regard, the contoured surfaces 72 that lie along the base 60 of the intervening block 44 between the knuckles 62 of that block confine the blocks 40 and 42 when the hinge A is closed (FIG. 5), whereas the closely space outer surfaces 52 on the two blocks 40 and 42 leave no room for radial displacement when the hinge A is open (FIG. 3). Thus, the bearing blocks 40 and 42 are confined to their respective notches 20, not only by the longitudinal edges 34 of the notches 30, which edges interlock with grooves 47 in the bases 46, but also by the outer surfaces 52 of the blocks 40 and 42 and contoured surfaces 72 of the intervening block 44. The transverse edges 32 of the notches 30 prevent the blocks 40 and 42 from shifting longitudinally relative to their respective leaves 2 and 4, and since the bearing blocks 40 and 42 cannot shift longitudinally with respect to each other by reason of the interlocked knuckles 48 and 62, the two leaves 2 and 4 cannot slide relative to each other along meshed teeth 18 of their gear segments 14. The friction which exists along the side faces 56 and 70 of the interlocked knuckles 48 and 50 for the bearing blocks 40, 42 and 44 is minimal, so the hinge A opens and closes with little resistance. Just as significant, the side faces 56 and 70 of the knuckles 48 and 62 experience little wear. Certainly, they experience less wear than the metal-to-polymer bearing surfaces of traditional gear hinges.

To prevent the clamp 6 from shifting longitudinally, the hinge A may be fitted with a conventional bearing block which carries a set screw that bears against the inside face of the bight portion 24 on the clamp 6. See U.S. Pat. No. 3,402,422. Since the bearings B carry the thrust load, the conventional bearing block does not experience any significant wear.

A modified bearing C (FIG. 11) likewise fits into notches 30 in the leaves 2 and 4 of the gear hinge A, but in contrast to the bearing B, it has only two components, namely a bearing block 80 on the leaf 2 and the bearing block 82 on the leaf 4. Each bearing block 80 and 82 has (FIG. 14) a base 84 provided with a groove 86 which receives the longitudinal edge 34 along the notch 30 into which it fits. Each also has a succession of knuckles 88 projecting from the base 84 into the interior of the clamp 6. To this end, each knuckle 88 has an arcuate inner surface 90 which fits around the cylindrical rib 26 of the clamp 6 and an outer surface 92 which is convex or arcuate for its full length from the base 84 to the free end of the knuckle 88. The outer face 92 lies close to the other cylindrical rib 26, that is the one opposite to the rib 26 around which the knuckle 88 wraps (FIGS. 12 and 13). Thus, the knuckles 88 of the bearing blocks 80 and 82 cross and project beyond the bisecting plane p of the bearing C. To this end, the knuckles 88 of the bearing block 80 are offset with respect to the knuckles 88 of the block 82. Thus, the knuckles 88 for the block 80 fit partially into the spaces between the knuckles 88 of the block 82 and vice-versa (FIG. 11). The knuckles 88 have flat bearing or side faces 94 which are squared off with respect to the pivot axes x, and end faces 96 which lie along the legs 26 of the clamp 6 when the hinge A is closed.

The overlap between the knuckles 88 of the two bearing blocks 80 and 82 permits the leaves 2 and 4 to move between their open and closed positions, in which event the side faces 94 of the knuckles 88 for the two blocks 80 and 82 simply slide over each other. The interlocking knuckles 88, of course, prevent the blocks 80 and 82 from shifting longitudinally relative to each other. Hence, the bearing C, like the bearing B, keeps the two leaves 2 and 4 from sliding along the teeth 18 of their gear segments 14.

Figure 15:
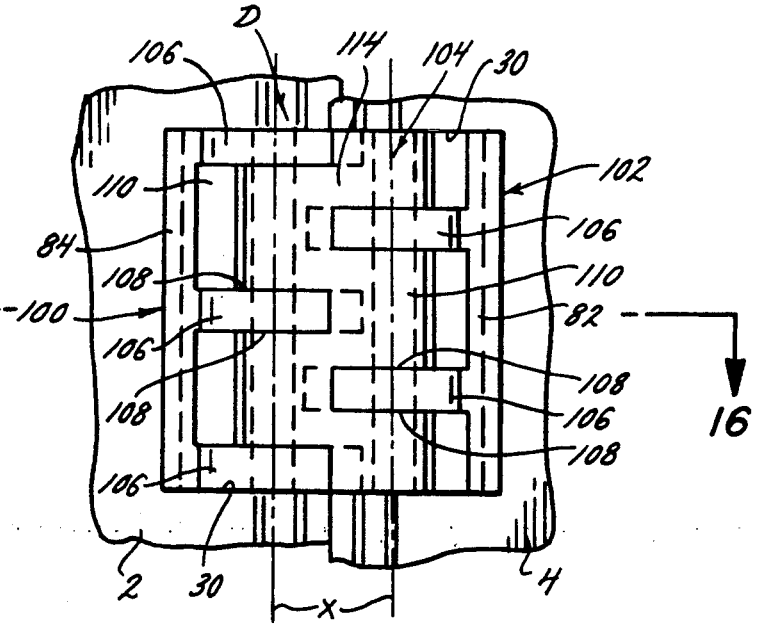
FIG. 15 is a front view of a bearing provided with another modified bearing.

Still another modified bearing D (FIG. 15) represents a combination of the concepts embodied in the bearings B and C. The bearing D has a bearing block 100 which fits in the notch 30 of the hinge leaf 2, another bearing block 102 which fits into the notch 30 of the hinge leaf 4, and an intervening bearing block 104 which fits into the clamp 6 and provides surfaces against which the other bearing blocks 100 and 102 work as the hinge leaves 2 and 4 move between their open and closed positions.

Figure 16:
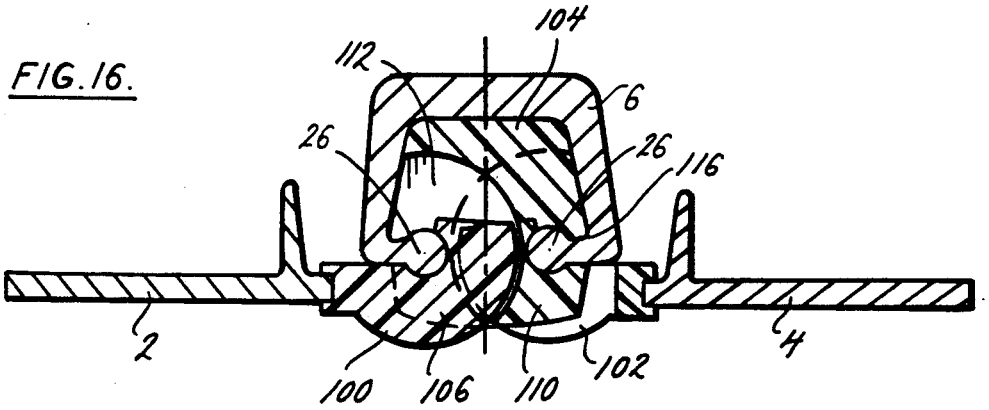
FIG. 16 is a sectional view taken along line 16—16 of FIG. 15.

The two bearing blocks 100 and 102, which attach to the leaves 2 and 4, respectively, each have knuckles 106 provided with side or bearing faces 108 which lie in planes perpendicular to the axes x. But the knuckles 106 of the leaf 2 do not align with the knuckles 106 of the leaf 4. Instead, the knuckles 106 of the two leaves 2 and 4 are offset and furthermore overlap, with the knuckles 106 on the leaf 2 projecting close to the clamp rib 26 that extends along the leaf 4 and vice-versa (FIG. 16). In contrast to the bearing C, the offset knuckles 106 of the two blocks 100 and 102 do not actually contact each other; indeed, spaces exist between the side faces 108 of the overlapping knuckles 106.

Figure 17:
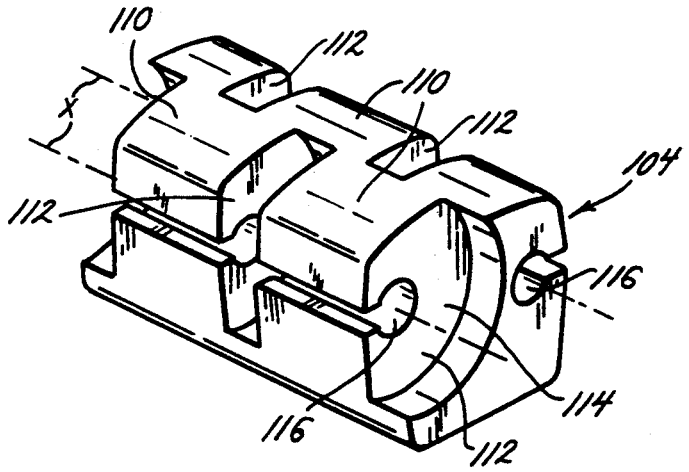
FIG. 17 is a perspective view of the intervening block for the modified bearing of FIG. 15.

The intervening block 104 (FIG. 17) likewise has knuckles 110 which have side faces 112 that lie in planes perpendicular to the axes x. The knuckles 110 of the block 104 fit into the spaces between the offset knuckles 106 on two blocks 100 and 102 such that the side faces 112 on the knuckles 110 are against the side faces 108 on the knuckles 106. To accommodate the alternating knuckles 106 of the two blocks 100 and 102, the knuckles 110 of the intervening block 104 are staggered alternately from one side of the block 104 to the other, with the staggered knuckles 110 being connected at webs 114. Indeed, the bearing or side faces 112 for the knuckles 110 extend out along the webs 114. As a consequence, the areas of actual contact between the opposed bearing or side faces 108 and 112 for the knuckles 106 and 110 of bearing D are greater than their counterparts in the bearings B and C. To a large measure, the webs 114 and the enlarged bearing or side faces 112 on the block 104 owe their existence to the fact that the bearing block 104, in contrast to the intervening bearing block 44 of the bearing B, projects out of the clamp at the space between the two cylindrical ribs 26. Indeed, the block 104 has somewhat cylindrical channels 116 through which the ribs 26 extend.

Considering the block 104 from a different perspective, it has several cavities opening out of each of its sides, and these cavities serve to separate the knuckles 110 on it and receive the knuckles 106 of the other blocks 100 and 102. The cavities on opposite sides of the block 104 in a sense overlap, thus creating the webs 114, and of course knuckles 106 from the other two blocks 100 and 102, being in the cavities, likewise overlap (FIG. 16).

With regard to the bearing B, in lieu of forming the side faces 56 on the knuckles 48 of its bearing blocks 40 and 42 and the contacting side faces 70 on the knuckles 62 at the intervening bearing block 44 perpendicular or squared off with respect to the pivot axes x, those faces 56 and 70 may be inclined in the configuration of mating helices to perform additional functions. For example, a simple helix will cause the door to rise as it opens or closes, depending on the direction of the helix, and as such the faces 56 and 70 would serve as cams which utilize the weight of the door to urge the door to one of the positions. Typically, the door would rise as it opens, and weight of the door, acting through the helical side faces 56 and 70 would urge the door to its closed position. Each of the faces 56 and 70 on the other hand may, in addition to the helix, have a reverse helix, with a low point where the helix and reverse helix meet. The weight of the door acting through the double helical surfaces would urge the door to the position at which the low points of the surfaces 56 and 70 align, to thus hold the door in a selected position, perhaps 45° open. This would be useful for doors, such as those on hospital rooms, which for much of the time are kept half open, yet tend to swing out of the half open position in the presence of air drafts.

In the modified bearing C the side faces 94 may likewise be contoured, and the same holds true of the side faces 108 and 112 in the modified bearing D.

This invention is intended to cover all changes and modifications of the example of the invention herein chosen for purposes of the disclosure which do not constitute departures from the spirit and scope of the invention.

What is claimed is:

1. A hinge comprising: a first leaf having a gear segment that establishes an axis and a notch opening out of the gear segment; a second leaf having a gear segment that is presented toward the gear segment of the first leaf and establishes another axis that is parallel to the axis of the gear segment on the first leaf, the second leaf also having a notch which opens out of its gear segment and is presented opposite the notch in the gear segment of the first leaf so that the notches of the gear segments on the leaves open torward each other; a clamp engaged with the gear segments of the first and second leaves such that it prevents the gear segments from moving apart, yet permits relative rotation between the gear segments; a plurality of bearing blocks located at the notches in the leaves, one of the bearing blocks being in the notch of first leaf where it is generally fixed in position with respect to the first leaf, another of the blocks being located in the notch of the second leaf where it is generally fixed in position with respect to the second left; the blocks having knuckles which interlock and prevent the blocks from shifting relative to each other in the direction of the axes of the gear segments, so that hinge leaves cannot shift relative to each other in the direction of the axes of their gear segments, at least one of the plurality of blocks having a plurality of knuckles and a base, with the plurality of knuckles projecting from the base.

2. A hinge according to claim 1 wherein the blocks are formed from a polymer.

3. A hinge according to claim 1 wherein each gear segment has a concave bearing surface, and the concave bearing surfaces of the two segments open away from each other; and wherein the clamp has cylindrical ribs that project into the bearing surfaces.

4. A hinge according to claim 1 wherein the gear segments of the two leaves mesh and the gear segments and clamp contact each along bearing surfaces, about which the clamp rotates relative to the leaves.

5. A hinge according to claim 4 wherein still another block is located in and generally fixed in position with respect to the clamp; and wherein the knuckles on the blocks of the leaves interlock with the knuckles on the other block in the clamp.

6. A hinge according to claim 5 wherein the knuckles for the bearing blocks that are on the leaves do not project beyond a plane that bisects the clamp and extends through the region where the gear segments of the leaves mesh.

7. A hinge according to claim 4 wherein the knuckles of the blocks on the two leaves are offset in the direction of elongation for the gear segments and interlock.

8. A hinge according to claim 7 wherein the knuckles of the blocks on the two leaves project across and beyond a plane that bisects the clamp and lies within the region where the gear segments mesh.

9. A hinge according to claim 4 wherein the blocks which are on the leaves have grooves which receive the leaves.

10. A gear hinge comprising an elongated first leaf having a longitudinally directed gear segment that curves about a concave bearing surface, the first leaf also having a notch that interrupts and opens out of the gear segment; an elongated second leaf having a longitudinally directed gear segment that curves about a concave bearing surface and engages the gear segment of the first leaf, whereby the concave bearing surfaces of the two leaves generally open away from each other, the second leaf also having a notch that interrupts and opens out of the gear segment for that leaf, the notch on the second leaf opening toward the notch on the first leaf; a clamp of generally U-shaped cross-section fitted generally over the gear segments of the two leaves and having generally cylindrical ribs which project into and bear against the concave bearing surfaces on the gear segments of the first and second leaves so as to prevent the gear segments from separating, while still permitting rotation to occur between the gear segments and the clamp, with the axes of such rotation being through the cylindrical ribs; a first bearing block located within the notch of the first leaf and generally fixed in position with respect to the first leaf, the first block having a plurality of longitudinally spaced knuckles; a second bearing block located in the notch of the second leaf and generally fixed in position with respect to that leaf, the second block having a plurality of longitudinally spaced knuckles; and a third bearing block located generally within the interior of the U-shaped clamp and having a plurality of longitudinally spaced knuckles which are offset with respect to the knuckles of the first and second blocks and fit into the spaces between the knuckles of the first and second blocks so as to prevent the first and second blocks from shifting longitudinally with respect to each other, whereby the leaves cannot shift longitudinally with respect to each other.

11. A hinge according to claim 10 wherein the knuckles of the first block engage that cylindrical rib of the clamp which bears against the bearing surface of the gear segment for the first leaf; and the knuckles of the second block engage that cylindrical rib of the clamp which bears against the bearing surface of the gear segment for the second leaf.

12. A hinge according to claim 11 wherein the knuckles of the first and second blocks, irrespective of the position of the leaves relative to each other, do not extend beyond a plane that bisects the clamp and extends through the region where the gear segments mesh.

13. A hinge according to claim 12 wherein each of the blocks has a base from which its knuckles project; wherein the base of the first block is fitted to the first leaf; wherein the base of the second block is fitted to the second leaf; and wherein the base of the third block lies along the bight of the U-shaped clamp.

14. A hinge according to claim 13 wherein the bases of the first and second blocks are provided with grooves which receive edges on the first and second leaves, respectively.

15. A gear hinge comprising: an elongated first leaf having a longitudinally directed gear segment that curves about a concave bearing surface, the first leaf also having a notch that interrupts and opens out of the gear segment; an elongated second leaf having a longitudinally directed gear segment that curves about a concave bearing surface and engages the gear segment of the first leaf, whereby the concave bearing surfaces of the two leaves generally open away from each other, the second leaf also having a notch that interrupts and opens out of the gear segment for that leaf and further opens toward the notch of the first leaf; a clamp of generally U-shape cross-section fitted generally over the gear segments of the two leaves and having generally cylindrical ribs which project into and bear against the concave bearing surfaces on the gear segments of the first and second leaves so as to prevent the gear segments from separating, while still permitting rotation to occur between the gear segments and the clamp, with the axes of such rotation being through the cylindrical ribs; a first bearing block located within the notch of the first leaf and generally fixed in position with respect to the first leaf, the first block having a plurality of longitudinally spaced knuckles; a second bearing block located in the notch of the second leaf and generally fixed in position with respect to the second leaf, the second block having a plurality of longitudinally spaced knuckles, the knuckles of the second block being offset longitudinally with respect to knuckles of the first block and being projected into the spaces between the knuckles of the first block, whereby the knuckles of the first and second blocks interlock and prevent the blocks and the leaves from shifting longitudinally with respect to each other.

16. A hinge according to claim 15 wherein the knuckles of the first block engage that cylindrical rib of the clamp which bears against the bearing surfaces of the gear segment for the first leaf; and the knuckles of the second block engage that cylindrical rib of the clamp which bears against the bearing surface of the gear segment for the second leaf.

17. A hinge according to claim 16 wherein the knuckles of the first and second blocks cross and extend beyond a plane that bisects the clamp and passes through the region where the gear segments mesh.

18. A hinge according to claim 17 wherein each of the blocks has a base from which its knuckles project; and wherein the base of the first block is fitted to the first leaf and the base of the second block is fitted to the second leaf.

19. A hinge according to claim 18 wherein the bases of the first and second blocks are provided with grooves which receive edges on the first and second leaves, respectively.

20. A hinge comprising: a first leaf having an elongated gear segment and a notch opening out of the gear segment; a second leaf having an elongated gear segment and a notch which opens out of its gear segment and is presented opposite to the notch of the first leaf, the gear segment of the second leaf being engaged with the gear segment of the first leaf, with the axes of the two gear segments being parallel; a clamp fitted over the gear segments and preventing them from moving apart, while permitting one leaf to rotate relative to the other leaf; a first bearing block located within the notch of the first leaf and being generally fixed in position with respect to the first leaf, the first block having at least one knuckle; a second bearing block located within the notch of the second leaf and being generally fixed in position with respect to the second leaf, the second block having at least one knuckle which is offset axially from the knuckle of the first block; and a third bearing block located at the notches in the first and second leaves and having cavities which open out of it and receive the knuckles of the first and second bearing blocks such that the knuckles of the first and second blocks bear against surfaces lining the cavities in the third block, whereby the bearing blocks will transmit a generally axially directed load from the first leaf to the second leaf.

21. A hinge according to claim 20 wherein the cavities in the third block overlap and the third block contains webs between the cavities where the cavities overlap; and wherein the knuckles of the first and second blocks overlap within the third block.

22. A hinge according to claim 21 wherein each of the first and second blocks has a plurality of knuckles.

* * * * *